US011349261B2

(12) United States Patent
Liu et al.

(10) Patent No.: US 11,349,261 B2
(45) Date of Patent: May 31, 2022

(54) ELECTRICAL CONNECTOR

(71) Applicants: FU DING PRECISION INDUSTRIAL (ZHENGZHOU) CO., LTD., Zhengzhou (CN); FOXCONN INTERCONNECT TECHNOLOGY LIMITED, Grand Cayman (KY)

(72) Inventors: Meng Liu, Kunshan (CN); Na Yang, Kunshan (CN); Yen-Chih Chang, New Taipei (TW); Yu-San Hsiao, New Taipei (TW); Shih-Wei Hsiao, New Taipei (TW)

(73) Assignees: FU DING PRECISION INDUSTRIAL (ZHENGZHOU) CO., LTD., Zhengzhou (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 17/144,164

(22) Filed: Jan. 8, 2021

(65) Prior Publication Data

US 2021/0210907 A1 Jul. 8, 2021

(30) Foreign Application Priority Data

Jan. 8, 2020 (CN) ..... 202010018061.6

(51) Int. Cl.
*H01R 24/00* (2011.01)
*H01R 13/6474* (2011.01)
(Continued)

(52) U.S. Cl.
CPC ..... *H01R 13/6474* (2013.01); *H01R 13/26* (2013.01); *H01R 13/405* (2013.01); *H01R 13/6477* (2013.01); *H01R 13/6471* (2013.01)

(58) Field of Classification Search
CPC .. H01R 13/6474; H01R 13/26; H01R 13/405; H01R 13/6477; H01R 13/6471
(Continued)

(56) References Cited

U.S. PATENT DOCUMENTS 5,256,084 A 10/1993 Kodama
6,115,260 A 9/2000 Nakajima et al.
9,520,680 B2 12/2016 Hsu et al.

FOREIGN PATENT DOCUMENTS

CN 201345438 Y 11/2009
CN 103515792 1/2014
(Continued)

*Primary Examiner* — Khiem M Nguyen
(74) *Attorney, Agent, or Firm* — Ming Chieh Chang; Wei Te Chung

(57) ABSTRACT

An electrical connector includes an insulative elongated housing, and a plurality of contacts retained to the housing. The housing includes a base extending along the longitudinal direction and a mating tongue extending forwardly from the base in a front-to-back direction perpendicular to the longitudinal direction. Each contact includes a contacting/mating section exposed upon the mating tongue. The contacts include a plurality of differential-pair signal contacts and a plurality of grounding contacts alternately arranged with each other along the longitudinal direction. Each differential-pair signal contact is associated with a metallic wiping piece in front with a tiny gap so as to have the distance between the rear end of the contacting section and the front edge of the wiping piece is still equal to 3.9 mm which is regulated by the industry standard specification as a full length of the contacting section of the traditional contact.

17 Claims, 12 Drawing Sheets

(51) Int. Cl.

| | |
|---|---|
| ***H01R 13/26*** | (2006.01) |
| ***H01R 13/405*** | (2006.01) |
| ***H01R 13/6477*** | (2011.01) |
| *H01R 13/6471* | (2011.01) |

(58) Field of Classification Search
USPC ..... 439/79, 660, 676
See application file for complete search history.

(56) References Cited

FOREIGN PATENT DOCUMENTS

| | | |
|---|---|---|
| CN | 203859328 U | 10/2014 |
| CN | 205693044 U | 11/2016 |
| CN | 107134669 | 9/2017 |
| CN | 108075276 | 5/2018 |
| CN | 207517943 | 6/2018 |
| CN | 207529373 | 6/2018 |
| CN | 109390802 | 2/2019 |

ELECTRICAL CONNECTOR

BACKGROUND OF THE INVENTION

1. Field of the Invention

The present invention relates to an electrical connector, and particular to the electrical connector having improved contact arrangement for high frequency transmission.

2. Description of Related Arts

China Patent No. CN103515792B discloses an electrical connector discloses an electrical connector using a transverse grounding bar to connect all the grounding contacts in the same row for enhancing the grounding effect. Anyhow, the impedance on the contacting sections of the differential-pair signal contacts is relatively low, due to mating with the complementary connector, thus jeopardizing the high frequency transmission.

Therefore, it is desired to provide an electrical connector with the standard interface for mating with the complementary connector and a relatively high impedance on the contacting section so as to perform the consistent impedance along the whole contact for high frequency transmission.

SUMMARY OF THE INVENTION

To achieve the above object, an electrical connector includes an insulative elongated housing, and a plurality of contacts retained to the housing. The housing includes a base extending along the longitudinal direction and a mating tongue extending forwardly from the base in a front-to-back direction perpendicular to the longitudinal direction. Each contact includes a contacting/mating section exposed upon the mating tongue. The contacts include a plurality of differential-pair signal contacts and a plurality of grounding contacts alternately arranged with each other along the longitudinal direction. Each differential-pair signal contact is associated with a metallic wiping piece in front with a tiny gap so as to have the distance between the rear end of the contacting section and the front edge of the wiping piece is still equal to 3.9 mm which is regulated by the industry standard specification as a full length of the contacting section of the traditional contact.

Other advantages and novel features of the invention will become more apparent from the following detailed description of the present embodiment when taken in conjunction with the accompanying drawings.

DETAILED DESCRIPTION OF THE PREFERRED EMBODIMENT

Figure 1:
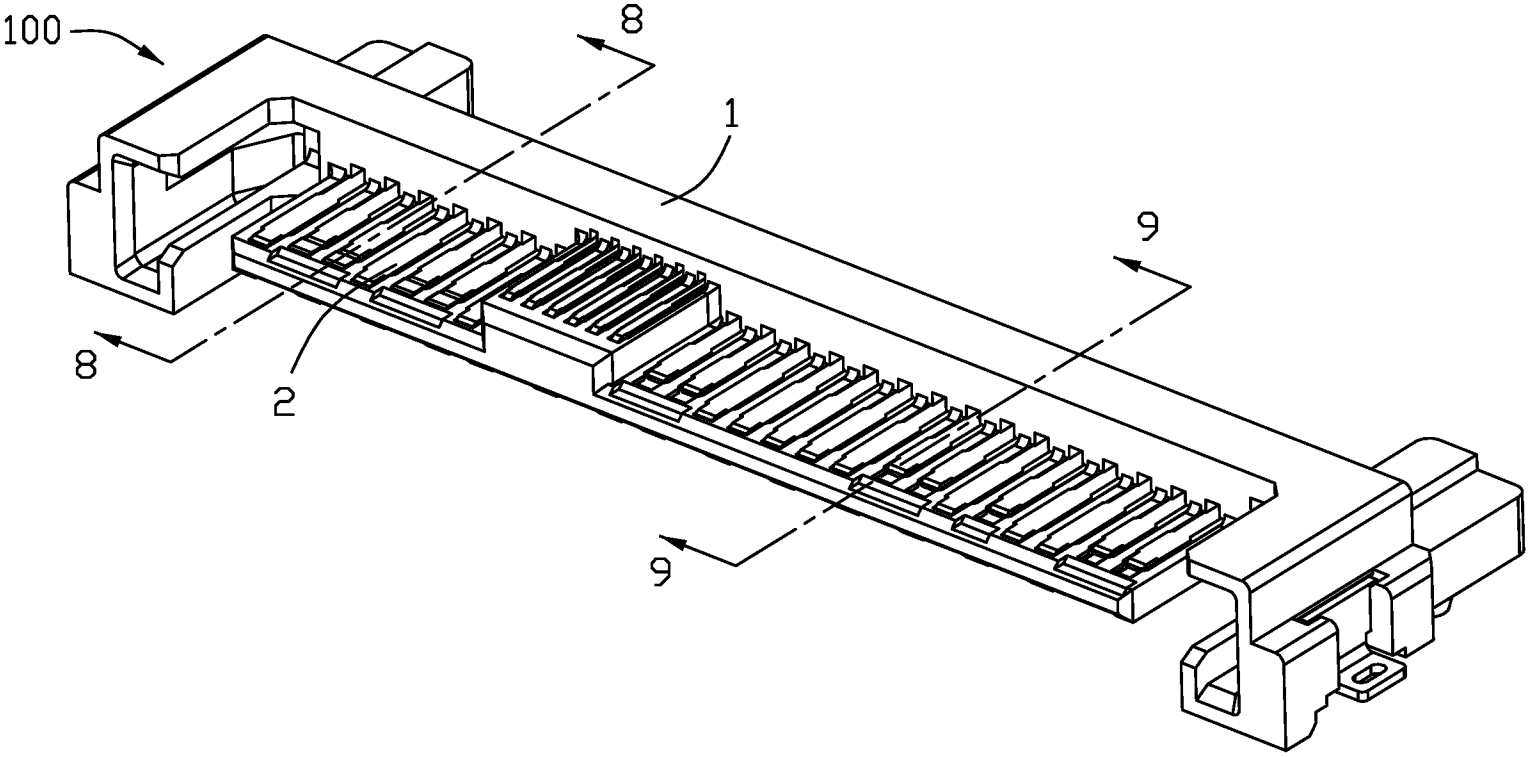
FIG. 1 is a perspective view of an electrical connector according to a first embodiment of the invention.
Figure 2:
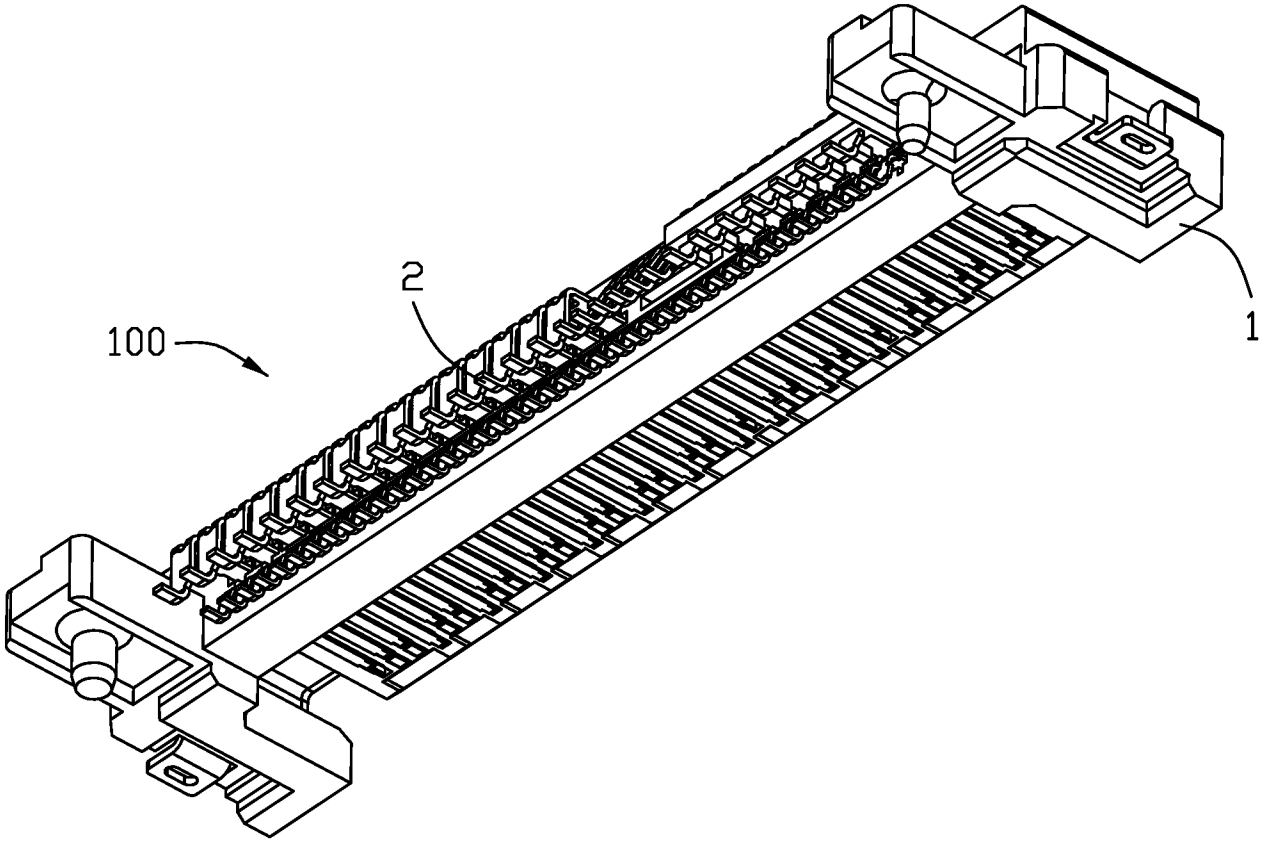
FIG. 2 is another perspective view of the electrical connector of FIG. 1.
Figure 3:
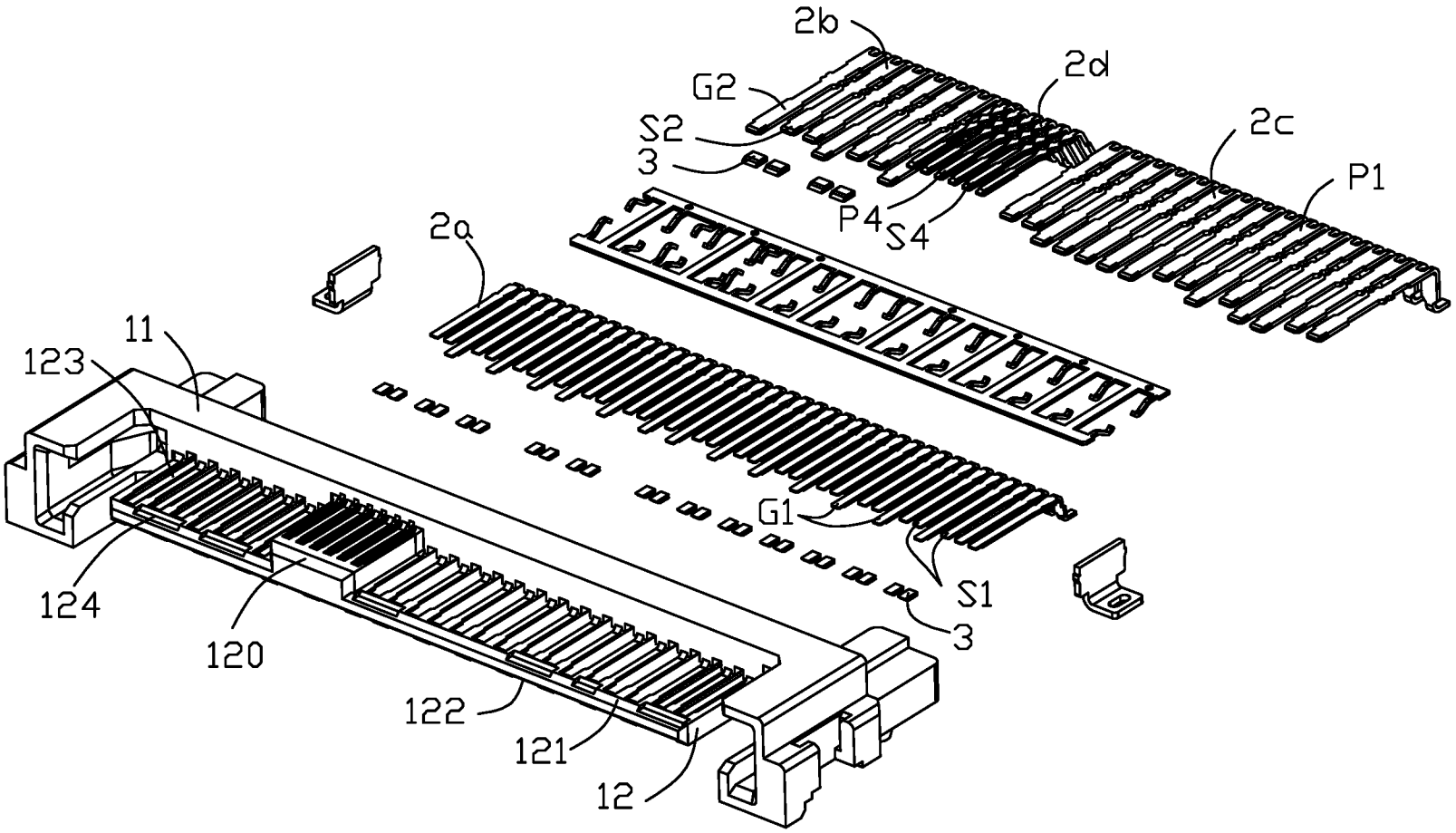
FIG. 3 is an exploded perspective view of the electrical connector of FIG. 1.
Figure 4:
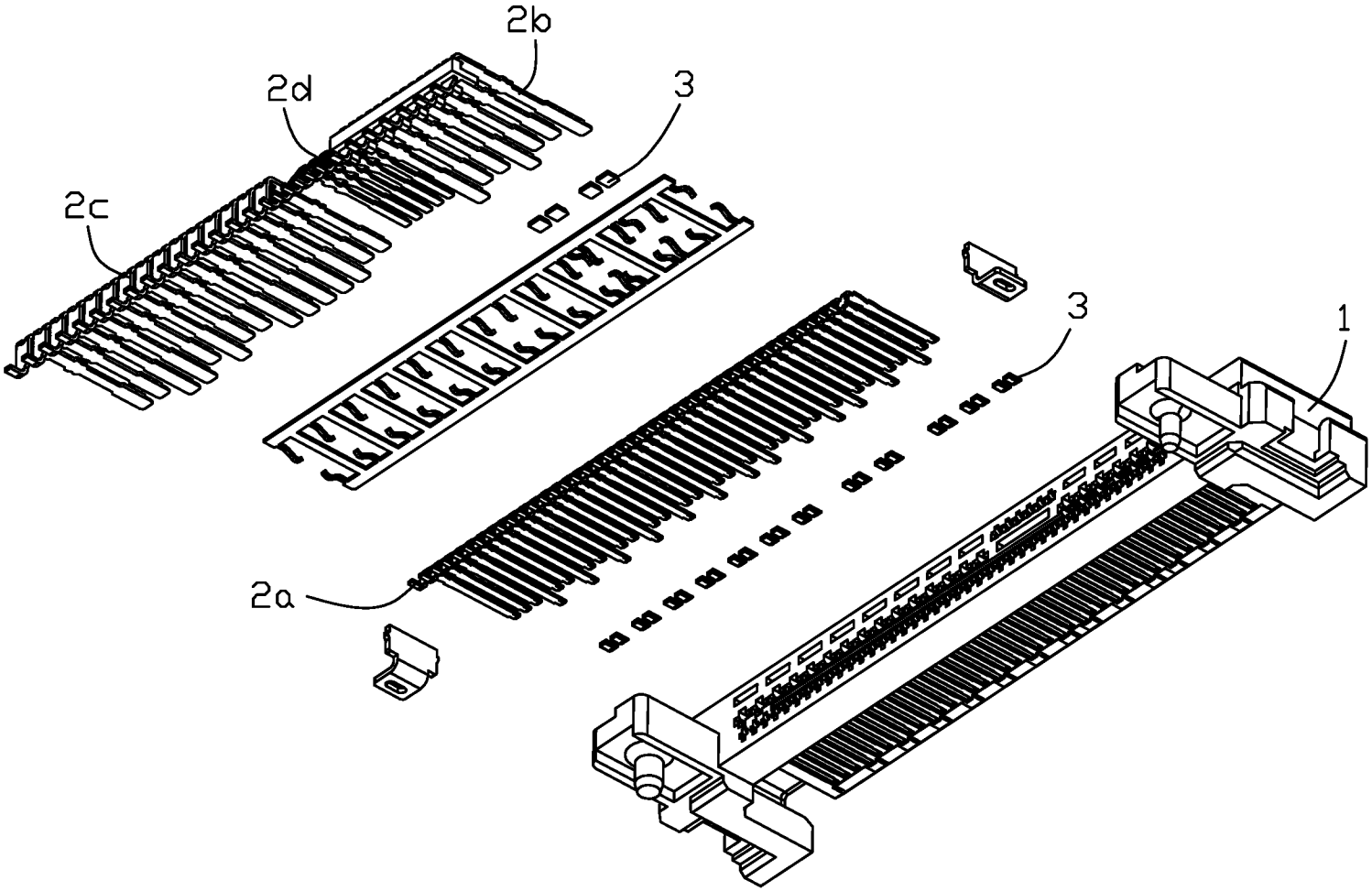
FIG. 4 is another exploded perspective view of the electrical connector of FIG. 3.
Figure 5:
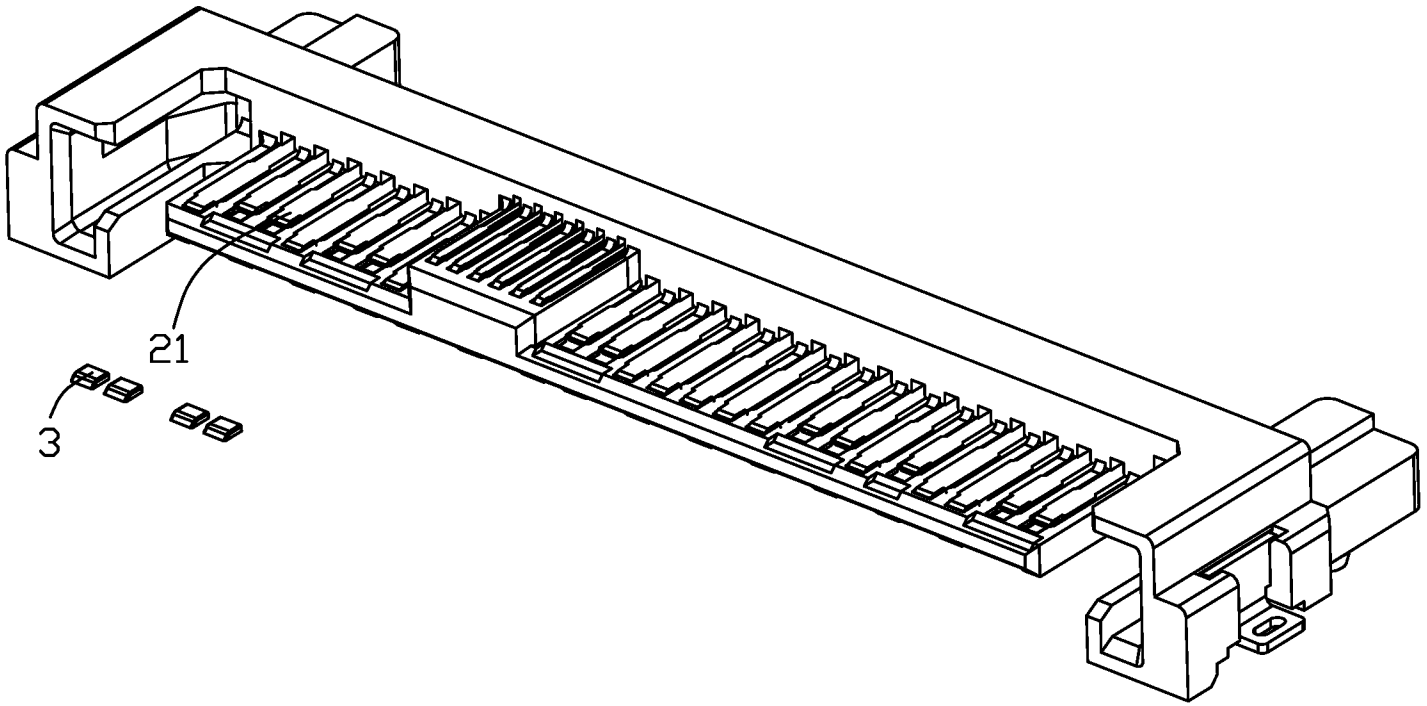
FIG. 5 is a perspective view of the electrical connector of FIG. 1 with some metallic wiping pieces are removed away from the housing.
Figure 6:
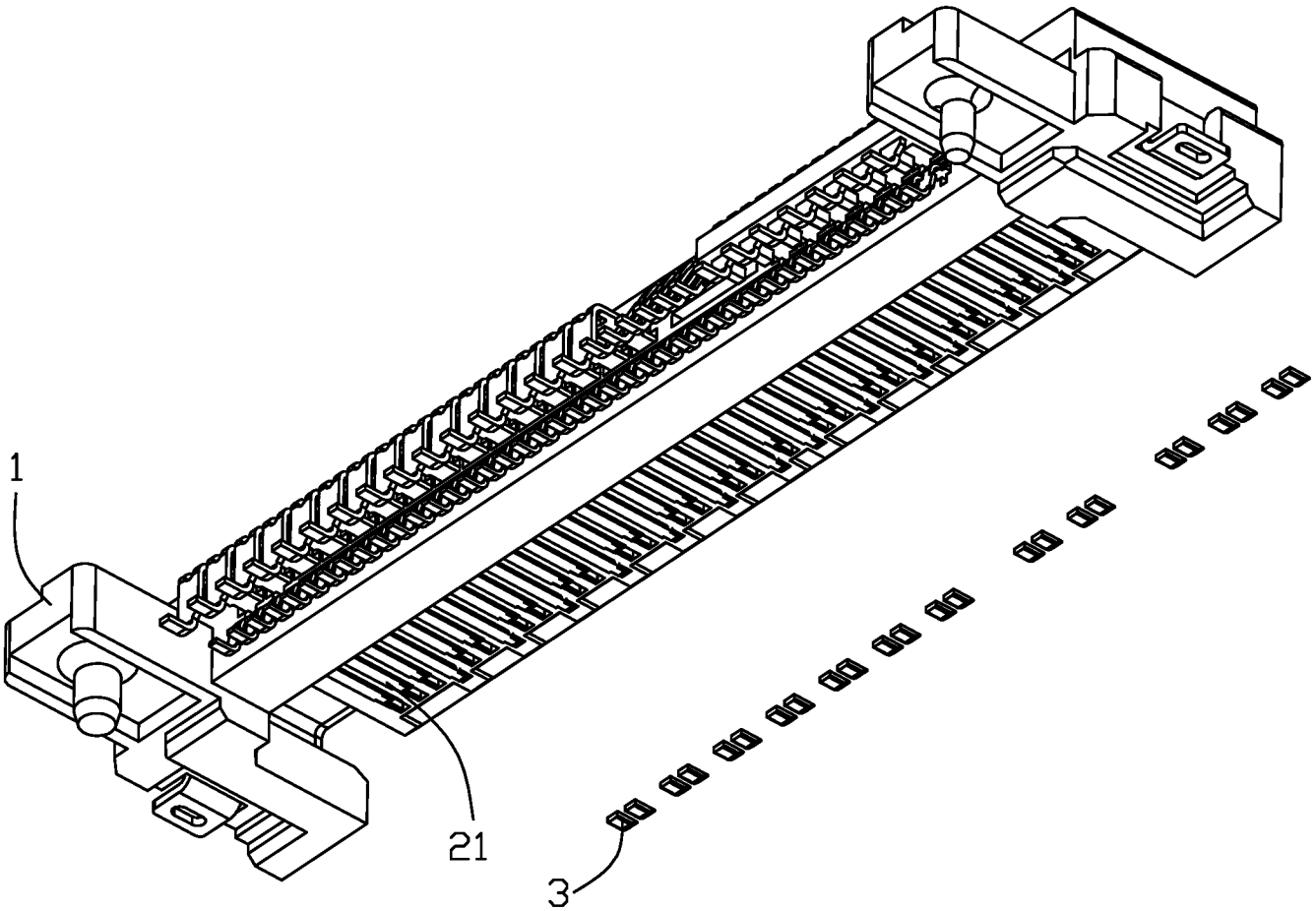
FIG. 6 is another perspective view of the electrical contact of FIG. 5.
Figure 7:
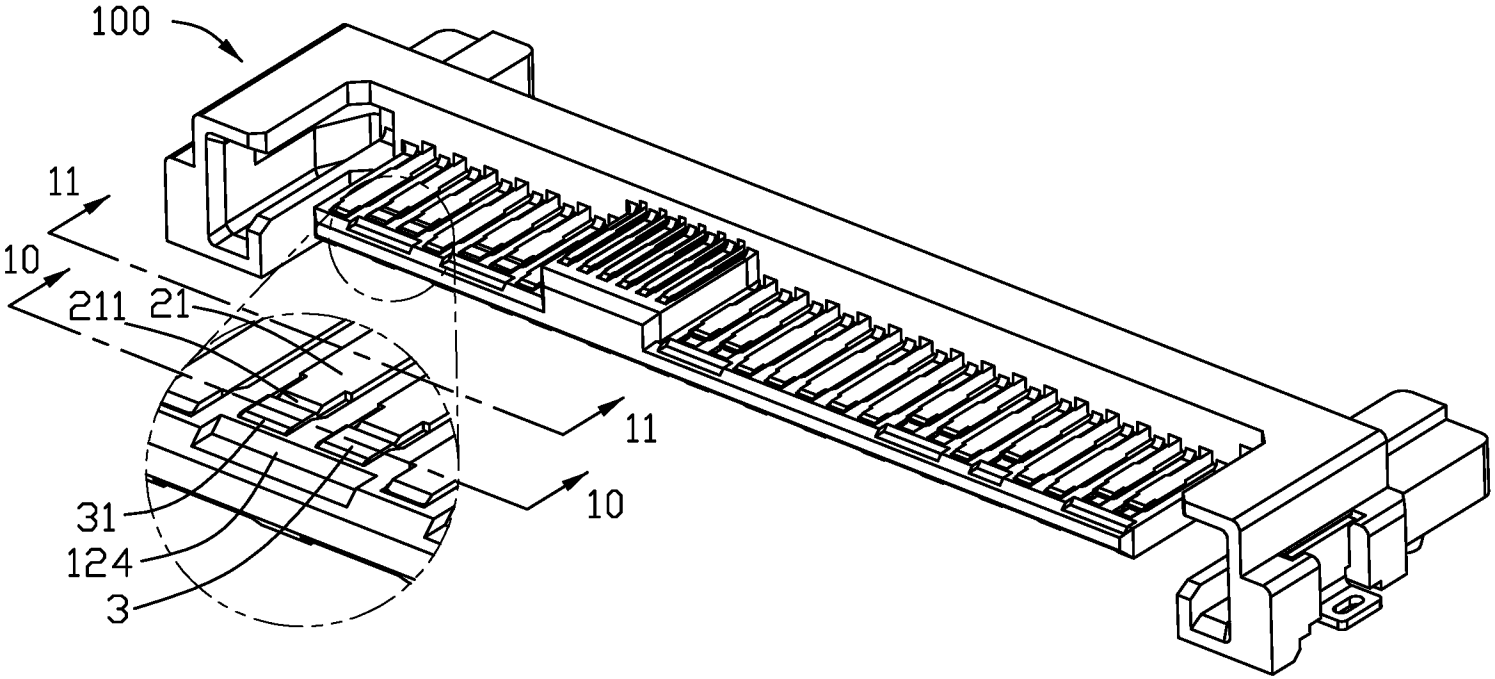
FIG. 7 is a perspective view of the electrical connector of FIG. 1 by showing an enlarged portion.

Referring to FIGS. 1-11, the electrical connector 100 is mateable with the complementary connector 200. The connector 100 includes an insulative housing 1 and a plurality of contacts 2 retained therein. The contacts 2 includes a plurality of differential-pair signal contacts S, the grounding contacts G and the power contacts P. The housing 1 includes an elongated base 11 extending along a longitudinal direction, and a mating tongue 12 extending forwardly from the base 11. The mating tongue 12 includes an upper/mating surface 121 and a lower/mating surface 122 opposite to each other in a vertical direction perpendicular to the longitudinal direction. A block 120 is formed on the upper surface 121. A plurality of passageways 123 are formed in the block 120, the upper surface 121 and the lower surface 122 to receive the corresponding contacts 2 therein. A plurality of recesses 124 are formed in a front edge of the mating tongue 12 in alignment with the differential-pair signal contacts S in the front-to-back direction perpendicular to both the longitudinal direction and the vertical direction.

Each contact 2 includes a front contacting section 21 exposed upon the mating tongue 12 for mating with the complementary connector 200, a rear soldering section 23 exposed outside of the housing for mounting to a printed circuit board, and a middle retaining section 22 therebetween with corresponding barbs (not labeled) for retaining the whole contact 2 in the housing 1. The contacting section 21 and the retaining section 22 are coplanar with each other so as to be forwardly assembled into the housing 1 from a back side of the housing 1. The contacts 2 include a first group 2*a* located on the lower surface 122, the second group 2*b* located by one side of the block 120, a third group 2*c* located by the other side of the block 120, and a fourth block 2*d* located upon the block 120. The first group 2*a* includes a plurality of differential-pair signal contacts S1 and a plurality of grounding contacts G1 alternately arranged with each other along the longitudinal direction. Similarly, the second group 2*b* includes a plurality of differential-signal contacts S2 and a plurality of grounding contacts G2 alternately arranged with each other in the longitudinal direction. The third group 2*c* includes the power contacts P1. The fourth group 2*d* includes the differential-pair signal contacts S4 and the power contact P4.

The front end of the contacting section 21 of each differential-pair signal contact is distanced from the front edge of the mating tongue 12 farther than that of the grounding contact is. In addition, a metallic wiping piece 3 is located between the front edge of the mating tongue 12 and the front end of the contacting section 21 of the differential-pair signal contact. Each metallic wiping piece is essentially embedded within a front edge region of the mating tongue 12 while being exposed to an exterior in the vertical direction and spaced from the front end of the contacting section 21 in the front-to-back direction with a minor gap d1 which is around 0.05 mm.

Figure 8:
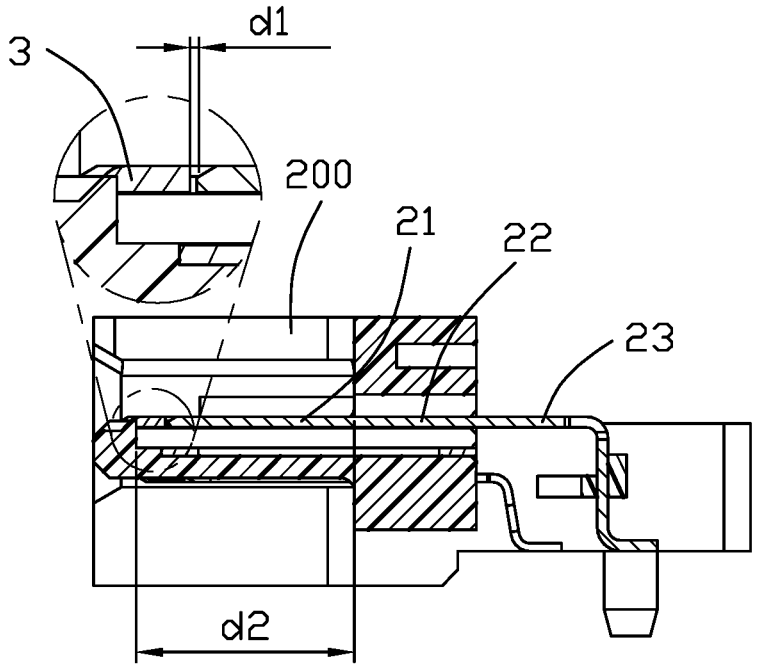
FIG. 8 is a cross-sectional view of the electrical connector of FIG. 1 along line 8-8.
Figure 9:
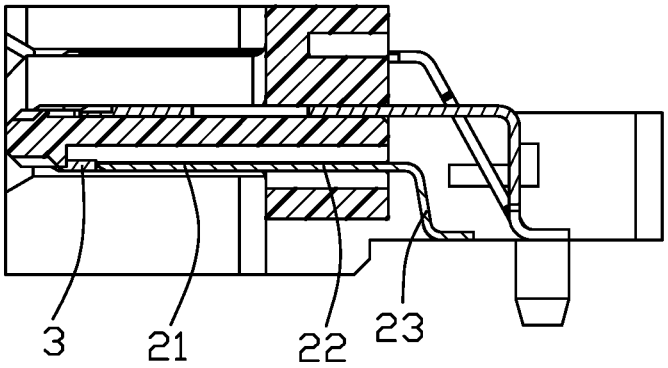
FIG. 9 is a cross-sectional view of the electrical connector of FIG. 1 along line 9-9.

As shown in FIGS. 8 and 9, the metallic wiping piece 3 and the corresponding contact share the same passageway 123 while the metallic wiping piece 3 is integrally formed within the housing 1 via insert-molding when the housing is formed while the contact 2 is forwardly assembled into the passageway 123 from the rear side of the housing 1 after the housing is formed. Both the front end 31 of the metallic wiping piece 3 and the front end 211 of the contacting section 21 is tapered for mating with the complementary connector.

Understandably, the distance from the front end 31 of the metallic wiping piece 3 to the rear end of the exposed contacting section 21 is 3.9 mm to comply with the standard specification in which the dimension of the exposed contacting section along the front-to-back direction is 3.9 mm. In other words, the contacting section 21 in the invention is essentially shorter than that regulated by the standard specification, i.e., SFF-8639, for adjusting the mating impedance advantageously from the electrical viewpoint while still maintaining the wiping function due to the metallic wiping piece 3 in front of the contacting section 21 with a tiny gap therebetween without electrical connection regard to the contacting section 21 from the mechanical viewpoint advantageously too.

Figure 10:
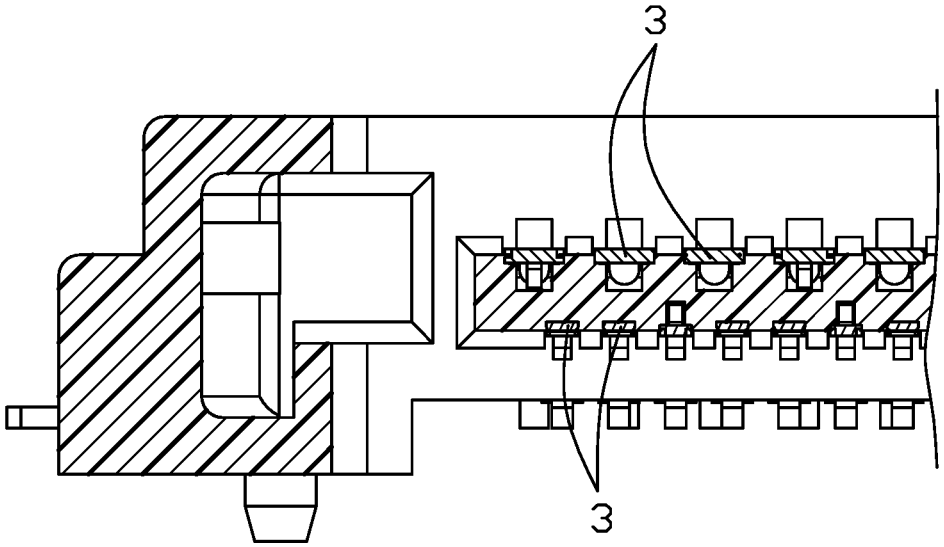
FIG. 10 is a cross-sectional view of the electrical connector of FIG. 7 along line 10-10.
Figure 11:
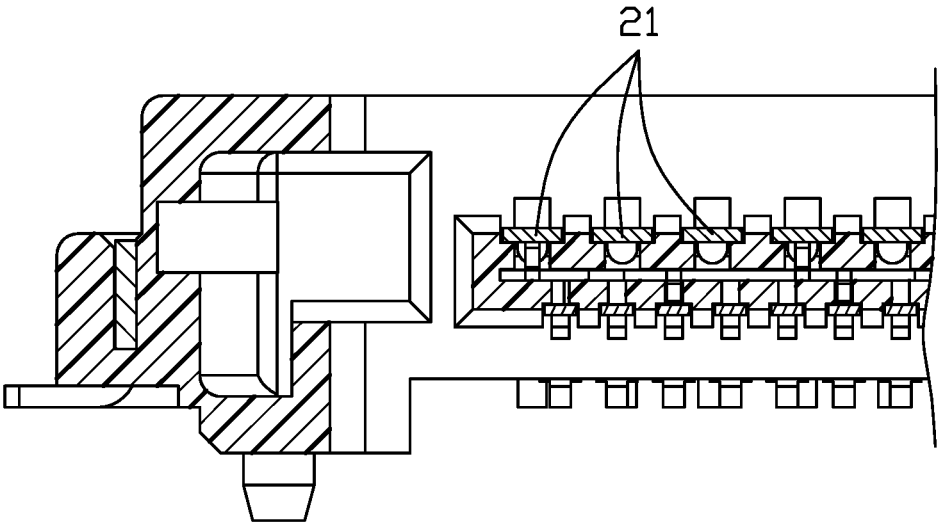
FIG. 11 is a cross-sectional view of the electrical connector of FIG. 7 along line 11-11.

It is noted that the contacting section 21 is supported by mating tongue 12 of the housing 1 on opposite two lateral sides thereof as shown in FIG. 11, and the corresponding metallic wiping piece 3 is also supported by the mating tongue 12 of the housing 1 on opposite two lateral sides thereof as shown in FIG. 10. Understandably, the air in the passageway 123 faces toward the contacting section 21 is good for impedance match of the contacting section 21, compared with the traditional design with the contacting section wholly directly seated upon the surface of the mating tongue intimately without the air therebetween. In this embodiment, material of the metallic wiping piece 3 is same with the contact 2. Alternately, a different inexpensive material with less conductivity and more strength may be used by the metallic piece 3 because metallic piece 3 is not required for electrical signal transmission but performing mechanical wiping function.

Figure 12:
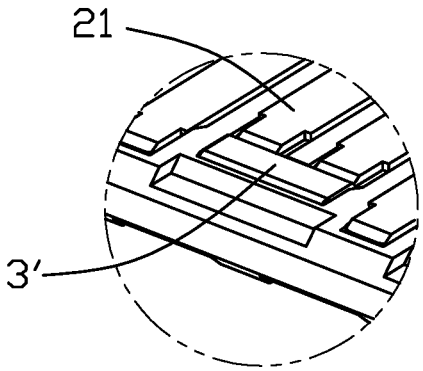
FIG. 12 is an enlarged perspective view of a portion of the electrical connector according to a second embodiment of the invention.

Referring to FIG. 12 showing the second embodiment, the paired metallic wiping pieces 3 may be unified together as one piece 3' for facilitating insert-molding consideration.

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An electrical connector comprising:

an insulative housing including a base extending in a longitudinal direction, and a mating tongue extending from the base in a front-to-back direction perpendicular to the longitudinal direction, the mating tongue defines two mating surfaces opposite to each other in a vertical direction perpendicular to both the longitudinal direction and the front-to-back direction;

a plurality of passageways formed in the housing and exposed in the mating surfaces in the vertical direction; and a plurality of contacts retained in the housing with corresponding front contacting sections exposed upon the mating surfaces, respectively, said contacts including a plurality of differential-pair signal contacts and a plurality of grounding contacts alternately arranged with each other along the longitudinal direction; wherein a plurality of metallic wiping pieces is integrally formed within the corresponding passageways of the housing, respectively, via an insert-molding process at a front edge region of the mating tongue, and each metallic wiping piece is exposed to an exterior in the vertical direction, and located in front of and spaced, with a tiny gap along the front-to-back direction, from the contacting section of the corresponding differential-pair signal contact which shares the same passageway with the metallic wiping piece.

2. The electrical connector as claimed in claim 1, wherein each contact further includes a rear soldering section and a middle retaining section between the front contacting section and the rear soldering section, and the retaining section includes barbs so as to have the contact forwardly assembled into the housing from a rear side of the housing after the housing is formed with the corresponding metallic wiping piece via the insert-molding process.

3. The electrical connector as claimed in claim 1, wherein the metallic wiping piece is made of material different from that of the contact.

4. The electrical connector as claimed in claim 1, wherein a distance from a front end of the metallic wiping piece to a rear end of the exposed contacting section of the corresponding contact sharing the same passageway, is 3.9 mm.

5. The electrical connector as claimed in claim 4, wherein the tiny gap between the metallic wiping piece and the contacting section of the corresponding contact sharing the same passageway is at least 0.05 mm.

6. The electrical connector as claimed in claim 1, wherein the passageway is empty behind the contacting section in the vertical direction except two lateral sides of the contacting section.

7. A method of making an electrical connector comprising steps of:

insert-molding a plurality of metallic wiping pieces within an insulative housing having a base extending along a longitudinal direction and a mating tongue extending forwardly from the base in a front-to-back direction perpendicular to the longitudinal direction, wherein a plurality of passageways are formed in the housing and extend in the front-to-back direction with the corresponding metallic wiping pieces laterally embedded therein at a front edge region of the mating tongue and exposed to an exterior in a vertical direction perpendicular to both the longitudinal direction and the front-to-back direction; and forwardly assembling a plurality of contacts into the corresponding passageways from a rear side of the housing, wherein each contact includes a front contacting section exposed upon the mating tongue and spaced from the corresponding metallic wiping piece with a tiny gap in said front-to-back direction.

8. The method as claimed in claim 7, wherein the gap is at least 0.05 mm.

9. The method as claimed in claim 7, wherein a distance from a front end of the metallic wiping pieces to a rear end of the exposed contacting section is 3.9 mm.

10. The method as claimed in claim 7, wherein each passageway is empty behind the contacting section of the corresponding contact in the vertical direction for impedance match consideration except two opposite lateral sides of the contacting section for retention consideration.

11. The method as claimed in claim 7, wherein each passageway is empty behind the corresponding metallic wiping piece in the vertical direction except two opposite lateral sides of the metallic wiping piece for retention consideration.

12. An electrical connector comprising:

an insulative housing including a base extending in a longitudinal direction, and a mating tongue extending from the base in a front-to-back direction perpendicular to the longitudinal direction, the mating tongue defines two mating surfaces opposite to each other in a vertical direction perpendicular to both the longitudinal direction and the front-to-back direction;

a plurality of passageways formed in the housing and exposed in the mating surfaces in the vertical direction; and a plurality of contacts retained in the housing with corresponding front contacting sections exposed upon the mating surfaces, respectively, said contacts including a plurality of differential-pair signal contacts and a plurality of grounding contacts alternately arranged with each other along the longitudinal direction; wherein a plurality of metallic wiping pieces is located within the corresponding passageways of the housing at a front edge region of the mating tongue, and each metallic wiping piece is exposed to an exterior in the vertical direction, and located in front of and spaced, with a tiny gap along the front-to-back direction, from the contacting section of the corresponding differential-pair signal contact which shares the same passageway with the metallic wiping piece.

13. The electrical connector as claimed in claim 12, wherein each contact further includes a rear soldering section and a middle retaining section between the front contacting section and the rear soldering section, and the retaining section includes barbs so as to have the contact forwardly assembled into the housing from a rear side of the housing after the housing is formed with the corresponding metallic wiping piece via the insert-molding process.

14. The electrical connector as claimed in claim 12, wherein the metallic wiping piece is made of material different from that of the contact.

15. The electrical connector as claimed in claim 12, wherein a distance from a front end of the metallic wiping piece to a rear end of the exposed contacting section of the corresponding contact sharing the same passageway, is 3.9 mm.

16. The electrical connector as claimed in claim 15, wherein the tiny gap between the metallic wiping piece and the contacting section of the corresponding contact sharing the same passageway is at least 0.05 mm.

17. The electrical connector as claimed in claim 12, wherein the passageway is empty behind the contacting section in the vertical direction except two lateral sides of the contacting section.

* * * * *